US007106212B2

(12) United States Patent
Konishi et al.

(10) Patent No.: US 7,106,212 B2
(45) Date of Patent: Sep. 12, 2006

(54) MOBILE RADIO COMMUNICATION FOR AUTOMATIC TOLL COLLECTION SYSTEM

(75) Inventors: Yoshimune Konishi, Okazaki (JP); Naoki Tokitsu, Kariya (JP); Wako Yamada, Okazaki (JP)

(73) Assignee: Denso Corporation, Kariya (JP)

( * ) Notice: Subject to any disclaimer, the term of this patent is extended or adjusted under 35 U.S.C. 154(b) by 786 days.

(21) Appl. No.: 09/799,039

(22) Filed: Mar. 6, 2001

(65) Prior Publication Data

US 2001/0025251 A1 Sep. 27, 2001

(30) Foreign Application Priority Data

Mar. 15, 2000 (JP) ..... 2000-077828

(51) Int. Cl.
*G08G 1/09* (2006.01)

(52) U.S. Cl. ..... 340/905; 701/200; 701/208; 701/213; 705/13

(58) Field of Classification Search ..... 705/13, 705/18; 701/209, 200; 340/905
See application file for complete search history.

(56) References Cited

U.S. PATENT DOCUMENTS

| | | | | |
|---|---|---|---|---|
| 5,485,520 | A * | 1/1996 | Chaum et al. | 705/74 |
| 5,508,917 | A | 4/1996 | Siegle et al. | |
| 5,952,940 | A * | 9/1999 | Matsumoto | 340/905 |
| 6,097,313 | A | 8/2000 | Takahashi et al. | |
| 6,295,503 | B1 * | 9/2001 | Inoue et al. | 701/209 |
| 6,335,693 | B1 | 1/2002 | Takahashi et al. | |
| 6,396,418 | B1 * | 5/2002 | Naito | 340/928 |
| 6,512,464 | B1 | 1/2003 | Takahashi et al. | |
| 6,653,946 | B1 * | 11/2003 | Hassett | 340/928 |
| 6,658,392 | B1 * | 12/2003 | Yoshida | 705/13 |
| 6,791,472 | B1 * | 9/2004 | Hoffberg | 340/905 |
| 6,959,282 | B1 * | 10/2005 | Kakihara et al. | 705/13 |

FOREIGN PATENT DOCUMENTS

| | | |
|---|---|---|
| DE | 4344433 A1 | 7/1995 |
| DE | 4426292 A1 | 2/1996 |
| DE | 4427392 A1 | 2/1996 |
| EP | 1 050 853 A1 | 11/2000 |
| JP | 62-224898 | 10/1987 |
| JP | A-H05-327577 | 12/1993 |
| JP | A-H10-243438 | 9/1998 |
| JP | A-H11-142175 | 5/1999 |
| JP | 11-351892 | 12/1999 |
| JP | 2000-057486 | 2/2000 |
| WO | WO 94/27256 | 11/1994 |

* cited by examiner

*Primary Examiner*—Romain Jeanty
(74) *Attorney, Agent, or Firm*—Posz Law Group, PLC

(57) ABSTRACT

A mobile radio communication device for an automatic toll collection system executes toll charging processing and travel guide. It communicates with road-side communication devices at an entrance gate and an exit gate in a toll charge area to receive map data. It also receives present position information from a GPS receiver circuit. It executes processing necessary for toll charging based on the received map data and present position information. It also provides a travel guide in the toll charge area.

11 Claims, 9 Drawing Sheets

FIG. 7A

TOLL AREA"IN"

FIG. 7B

A CONVENIENCE STORE
WILL SOON APPEAR
ON YOUR LEFT

FIG. 7C

| | |
|---|---|
| TOLL CHARGE | ¥○○○○ |
| NORMAL TOLL AREA | ××Km |
| SPECIAL TOLL AREA | △△Km |

FIG. 7D

BALANCE ¥○○○○

FIG. 7E

NO IC CARD

MOBILE RADIO COMMUNICATION FOR AUTOMATIC TOLL COLLECTION SYSTEM

CROSS REFERENCE TO RELATED APPLICATION

This application is based on and incorporates herein by reference Japanese patent application No. 2000-77828 filed Mar. 15, 2000.

BACKGROUND OF THE INVENTION

The present invention relates to a mobile radio communication device and method for an automatic toll collection system which charges a toll by executing communications with a road-side communication device.

A conventional automatic toll collection system charges toll of a toll road by executing a dedicated short range communication (DSRC) between a road-side communication device and a mobile radio communication device.

In this automatic toll collection system, a gate installed with the road-side communication device is provided in every section in a specified toll road, and toll is charged basically based on the number of sections which the vehicle has traveled.

In the mobile radio communication device used in the automatic toll collection system, transmission and reception of data necessary for toll charging is attained by executing the dedicated short range communication with the road-side communication device only in a specific communication zone of the road-side communication device.

SUMMARY OF THE INVENTION

It is an object of the present invention to attain toll charging processing not only based on a section distance in a single toll road but also on an actual travel distance in a specified area between gates.

It is another object of the present invention to provide a travel guide in addition to automatic toll charging.

It is a further object of the present invention to enable automatic toll charging including travel in a special toll area, when the toll charge area includes the special toll area.

According to the present invention, a mobile radio communication device receives map data from a road-side communication device and present position information from a GPS receiver. The mobile radio communication device calculates an actual distance of travel by using the received map data and present position information, and calculates a toll based on the calculated actual distance of travel. In addition or alternatively, the mobile radio communication device provides a travel guide by using the received map data and present position information. Preferably, the mobile radio communication device also receives map data at an exit of a toll area to provide travel guide even after passing the toll area.

BRIEF DESCRIPTION OF THE DRAWINGS

The above and other objects, features and advantages of the present invention will become more apparent from the following detailed description made with reference to the accompanying drawings. In the drawings:

FIGS. 7A to 7E are diagrams showing exemplary displays of information on a display in the first embodiment;

DETAILED DESCRIPTION OF THE PREFERRED EMBODIMENT

The present invention will be described with reference to various embodiments.

First Embodiment

Figure 1:
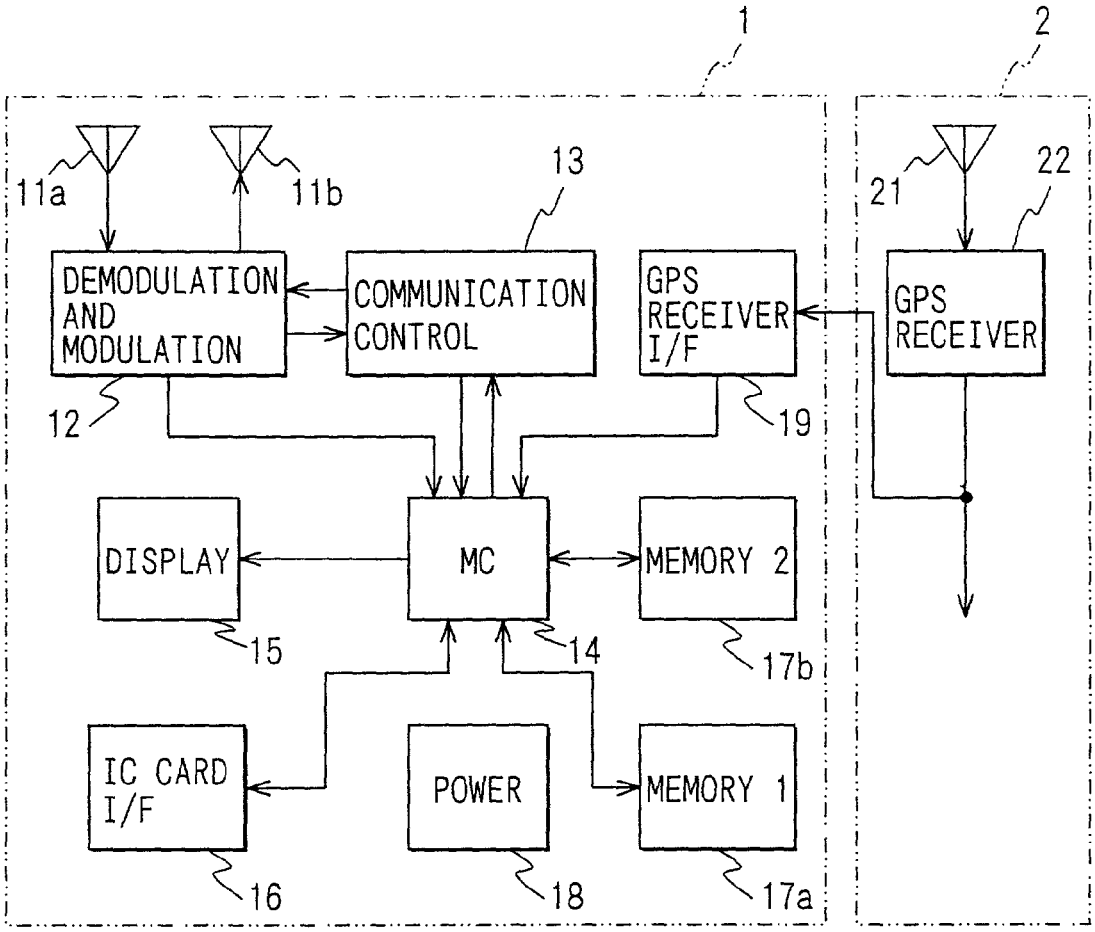
FIG. 1 is a block diagram showing a mobile radio communication device mounted in a vehicle for automatic toll collection system according to a first embodiment of the present invention.

Referring first to FIG. 1, a mobile radio communication device is mounted in a vehicle (mobile body) as an in-vehicle radio communication device 1 together with a navigation system 2.

The in-vehicle radio communication device 1 is constructed with antennas 11*a*, 11*b*, a demodulation and modulation circuit 12, a communication control circuit 13, a microcomputer (MC) 14, a display unit 15, an IC card interface (I/F) 16, first and second memories 17*a*, 17*b*, a power supply circuit 18, and a GPS receiver I/F 19. Each electrical circuit of the in-vehicle radio communication device 1 is supplied with electric power from the power supply circuit 18 connected to a vehicle-mounted battery or built-in battery (not shown).

The navigation system 2 is constructed with a GPS antenna 21 and a GPS receiver circuit 22. The GPS receiver circuit 22 of the navigation system 2 applies a present position signal indicative of a present position of the vehicle to the GPS receiver I/F 19 of the in-vehicle radio communication device 1.

Figure 2:
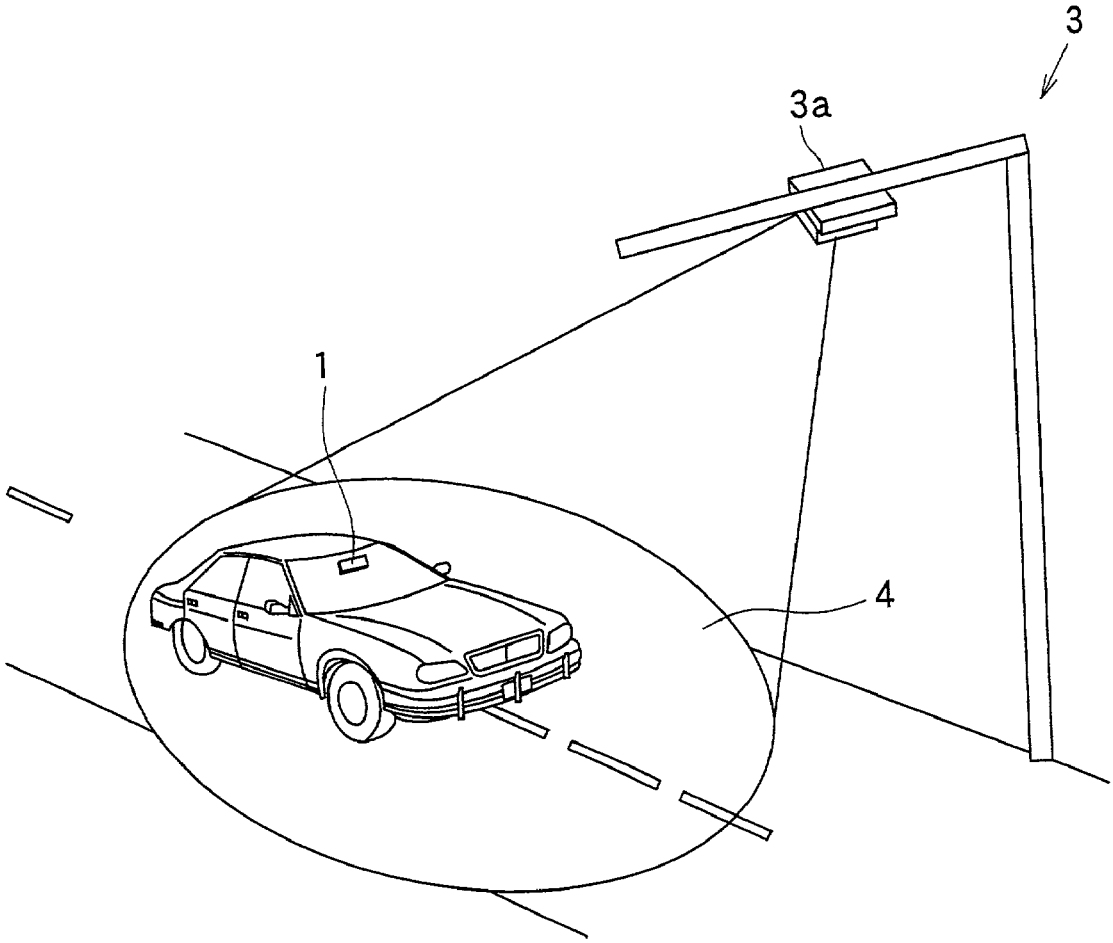
FIG. 2 is a schematic view showing a communication zone of a road-side communication device.

When a vehicle passes by a road-side communication device 3 having a road-side antenna 3*a* as shown in FIG. 2, the in-vehicle radio communication device 1 executes radio communications with the road-side communication device 3 through the antennas 11*a*, 11*b* within a communication zone (DSRC communication zone) 4. In this instance, a carrier wave radiated from the road-side antenna 3*a* of the road-side communication device 3 is transmitted through the receiver antenna 11*a*, and is applied to the microcomputer 14 as a carrier level signal from the demodulation and modulation circuit 12. When the microcomputer 14 determines based on the carrier level signal that the vehicle has entered the communication zone 4, the microcomputer 14 communicates with the road-side communication device 3 through the antennas 11*a*, 11*b*, the demodulation and modulation circuit 12 and the communication control circuit 13. The microcomputer 14 transmits information data (user ID, vehicle ID, IC card information, etc.) of the vehicle side to the road-side communication device 3, and receives information data (passing gate number, passing time, passing vehicle model information detected by the road-side communication device 3, etc.) from the road-side communication device 3. The transmission and reception of these data necessary for automatic toll collection are made similarly as in the conventional automatic toll collection system.

In this embodiment, the information data which the in-vehicle radio communication device 1 receives from the road-side communication device 3 includes map data of a toll charge area which is covered by the road-side communication device 3. The in-vehicle radio communication device 1 provides a travel guide in the toll charge area based on the map data. The map data includes guide information for providing travel guides.

Figure 3:
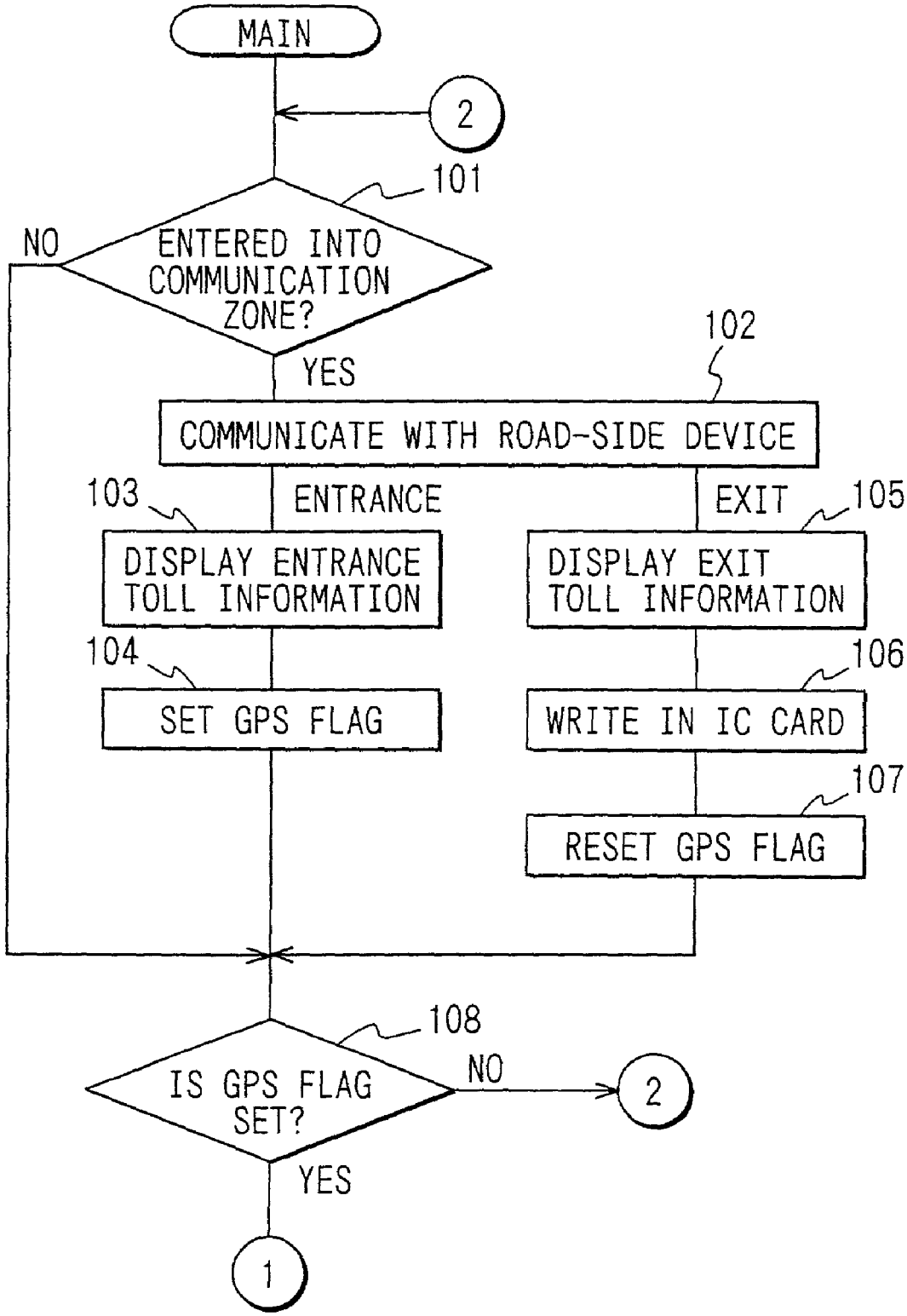
FIG. 3 is a flow diagram showing a part of main routine processing executed in the first embodiment.
Figure 4:
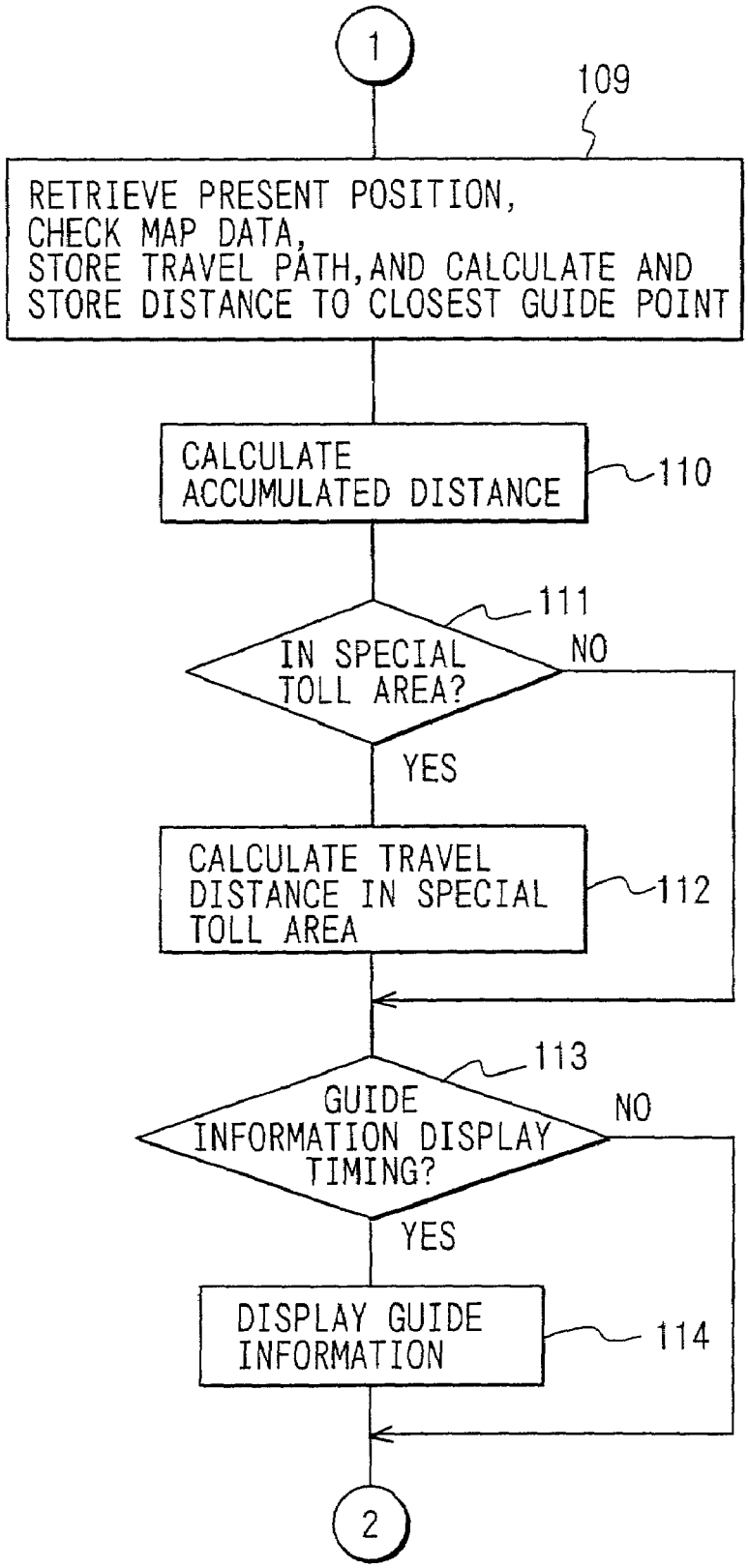
FIG. 4 is a flow diagram showing the other part of the main routine processing executed in the first embodiment.
Figure 5:
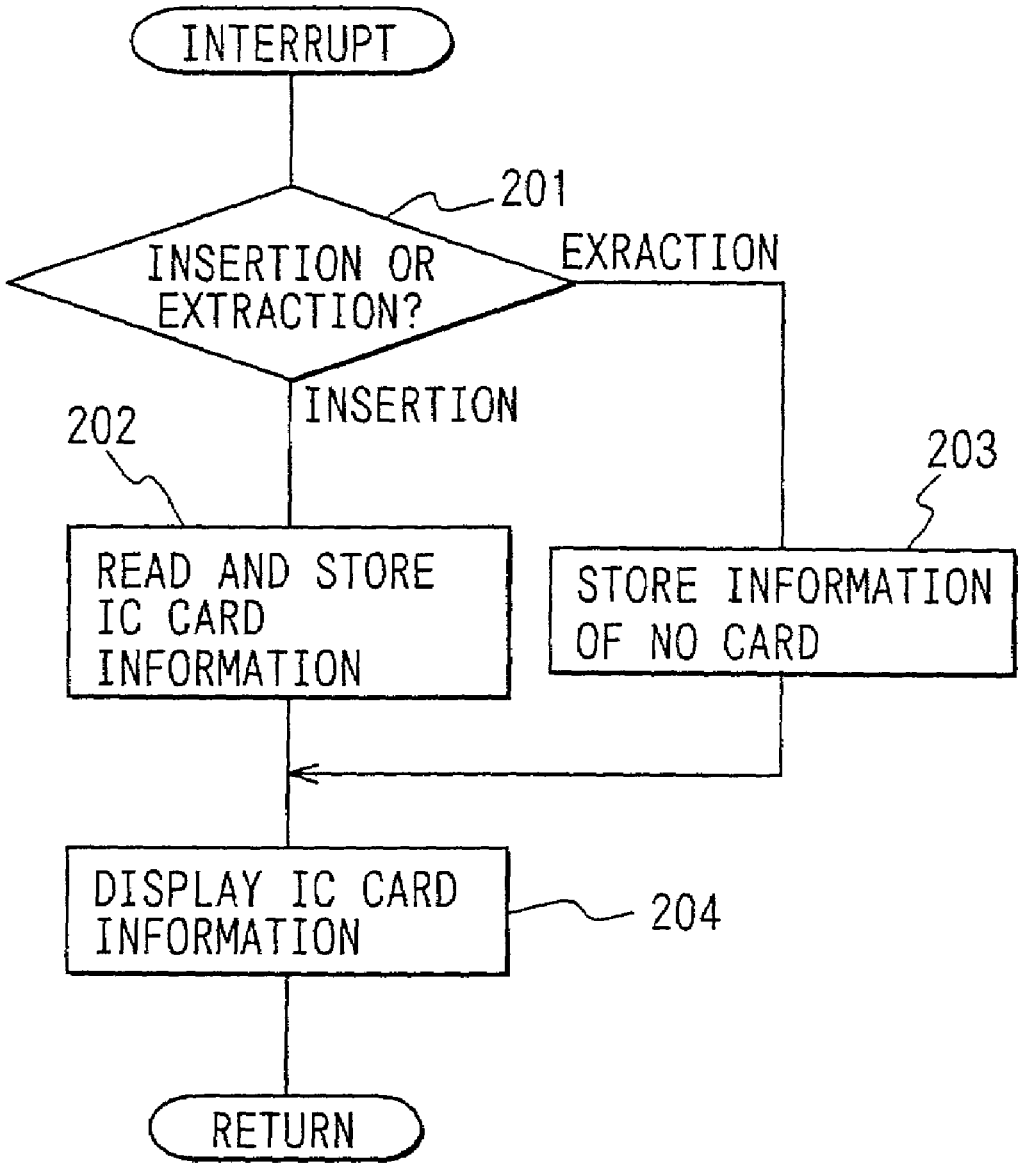
FIG. 5 is a flow diagram showing interrupt routine processing executed in the first embodiment.

Operation of the above in-vehicle radio communication device will be described with reference to flow diagrams of FIGS. 3 to 5 showing processing of the microcomputer 14 and exemplary map display of FIG. 6. The microcomputer 14 repeats main routine processing shown in FIGS. 3 and 4 at a predetermined time interval.

Figure 6:
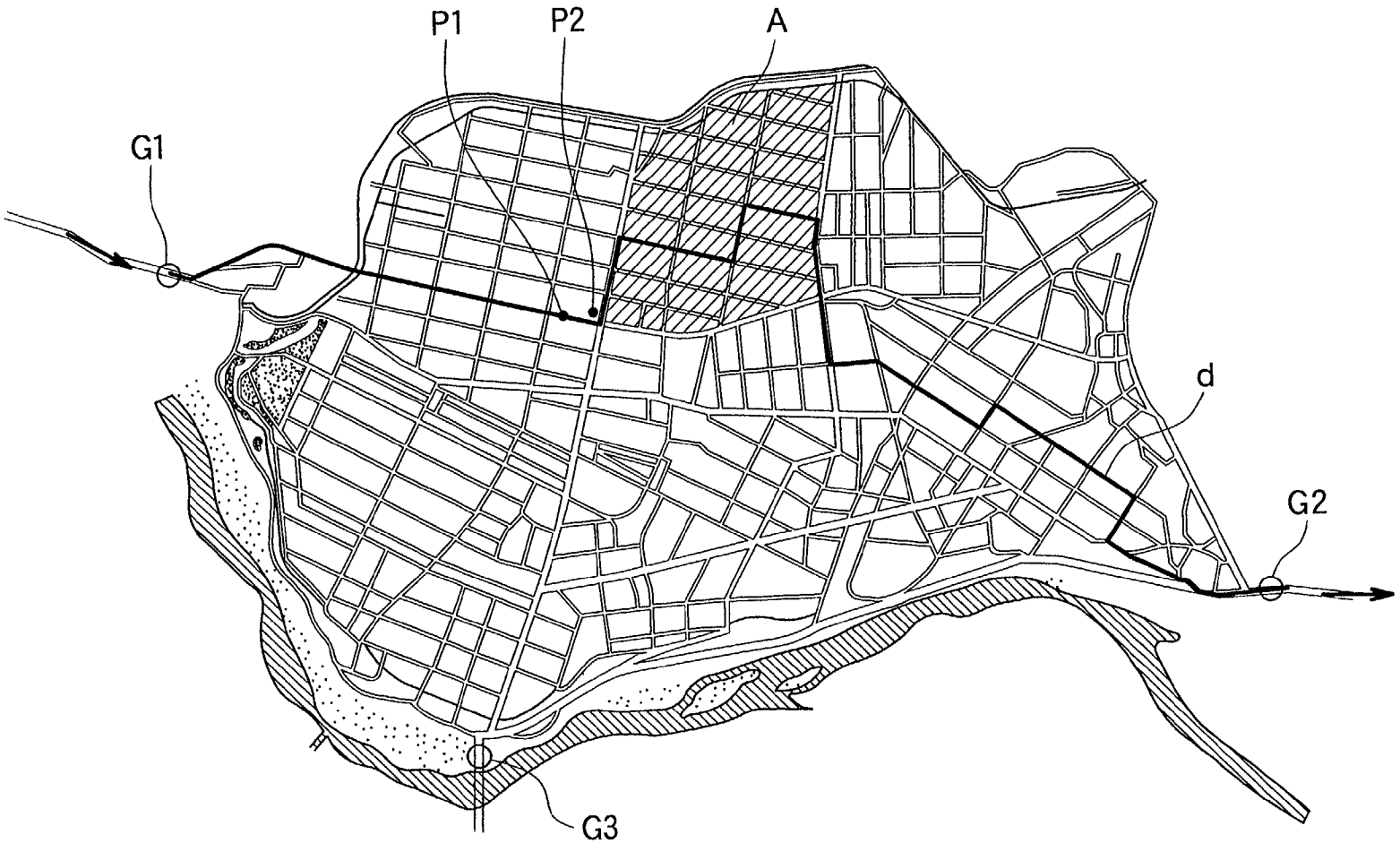
FIG. 6 is a map diagram showing an exemplary travel path of a vehicle.

It is assumed that a vehicle enters a toll charge area from an entrance gate G1 shown in FIG. 6 and arrives at an exit gate G2 shown in FIG. 6, traveling along a path indicated with a bold line.

First, the microcomputer 14 checks at step 101 whether the vehicle has entered the communication zone 4 of the road-side communication device 3. It determines that the vehicle has entered the communication zone 4, if the carrier level signal produced from the demodulation and modulation circuit 12 exceeds a predetermined level due to entrance of the vehicle into the communication zone 4.

The microcomputer 14 executes communication processing with the road-side communication device 3 at step 102 to transmit and receive information data necessary for toll charging processing, upon determination of entrance into the communication zone 4.

Upon entering the communication zone 4 of the entrance gate G1, the microcomputer 14 executes communication processing of information data necessary for the toll charging processing at the entrance gate G1. For instance, the in-vehicle radio communication device 1 transmits data such as user information and IC card information stored in the memory 17*a* to the road-side communication device 3 at the entrance gate G1. It receives data such as passing gate number, passing time and passing vehicle model information from the road-side communication device 3. It stores the received data in its memory 17*a*. It further receives map data of the toll charge area and stores the received map data in the memory 17*b*.

The microcomputer 14 drives the display unit 15 to display entrance toll charge information at step 103. The display unit 15 is a dot matrix display type such as an LCD display, for instance, which is capable of displaying information in characters. As shown in FIG. 7A, the display unit 15 displays 'TOLL AREA "IN"' as the entrance toll charge information. Then, the microcomputer 14 sets a GPS measurement flag at step 104.

The microcomputer 14 checks at step 108 whether the GPS measurement flag is set. This check result continues to be YES each time the processing proceeds to step 108 until the GPS measurement flag is reset, once the GPS measurement flag has been set at step 104.

The microcomputer 104 then executes step 109 shown in FIG. 4. It retrieves the present position signal indicative of the present position of the vehicle from the GPS receiver circuit 22 through the receiver I/F 19 at step 109. It checks the present position of the vehicle with the map data stored in the memory 17*b*, and stores as travel path data the present position of the vehicle on the map. For displaying guide information, it further calculates and stores in the memory 17*b* a distance from the present position to a point (closest guide point) which is closest to the present position among various guide points such as buildings and areas including department stores, parking lots, convenience stores, public offices, public buildings or sightseeing spots.

The microcomputer 14 calculates at step 110 an accumulated travel distance covering from the entrance gate G1 to the present position based on the travel path data stored in the memory 17*b* at step 109. If the toll charge area includes a special toll area (hatched area indicated with A in FIG. 6) for which a special toll is charged, the microcomputer 14 checks whether the vehicle is traveling in the special toll area at step 111 by checking the present position of the vehicle with the map data. The microcomputer 14 calculates at step 112 a travel distance in the special toll area based on the travel path data stored in the memory 17*b* at step 109, if the vehicle is traveling in the special toll area.

The microcomputer 14 checks at step 113 whether the distance to the closest guide point calculated at step 109 decreased to a predetermined distance (display timing), that is, whether the vehicle is approaching to the closest guide point. If the check result indicates that the distance decreased to the predetermined distance, the microcomputer 14 drives the display unit 15 to display guide information related to the guide point at step 114.

It is assumed here that the present position of the vehicle is at point P1 in FIG. 6 and the guide point is a convenience store which is at point P2 in FIG. 6. When the distance between P1 and P2 decreased to the predetermined distance, the microcomputer 14 drives the display unit 15 to display 'A CONVENIENCE STORE WILL SOON APPEAR ON YOUR LEFT' as shown in FIG. 7B.

As long as the vehicle is traveling in the toll charge area, the microcomputer 14 repeats the above processing. That is, it calculates the distance to the closest guide point, accumulated travel distance and the travel distance in a special area if such a special area exists. It further drives the display unit 15 to display the guide information corresponding to the closest guide point if such a closest guide point exists within the predetermined distance. The display of guide information is continued for a predetermined time period or until the vehicle arrives at the closest guide point.

When the vehicle arrives at the exit gate G2 thereafter, the microcomputer 14 determines at step 101 in FIG. 3 that the vehicle has entered a communication zone 4 of the exit gate G2. The microcomputer 14 executes at step 102 communication processing with the road-side communication device 3 at the exit gate G2 to transmit and receive information data necessary for the toll charging processing. In this instance, toll charge communication processing is executed at the exit gate G2, because the communication zone 4 is the communication zone of the exit gate G2. That is, the accumulated travel distance and the travel distance in the special toll area calculated at step 109 are transmitted to the road-side communication device 3 so that corresponding toll charge amount and the like are received in response from the road-side communication device 3.

The microcomputer 14 drives the display unit 15 to display the exit toll charge information at step 105. For instance, as shown in FIG. 7C, the display is 'toll charge ○○○○ yen, normal toll area X X km, special toll area ΔΔ km.' The normal toll area is an area other than the special toll area, and the travel distance in the normal toll area is calculated by subtracting the travel distance in the special toll area from the accumulated travel distance. The toll charge amount is calculated based on the travel distance in the normal toll area and the travel distance in the special toll area.

The microcomputer 14 writes into the IC card through the IC card I/F 16 the toll charge amount corresponding to the travel distance in the toll charge area and the balance to be maintained in the IC card at step 106, as a result of toll charging processing executed by way of the communication with the road-side communication device 3. The microcomputer 14 then resets the GPS measurement flag at step 107. The microcomputer 14 thereafter does not execute processing of calculations of the distance to the closest guide point, the accumulated travel distance and the distance of travel in the special area, nor processing of the travel guide. Instead, it checks at step 101 whether the vehicle has entered a communication zone 4.

In addition to the above processing of the main routine, the microcomputer 14 executes processing of an interrupt routine shown in FIG. 5, when the IC card is inserted into or extracted from the in-vehicle radio communication device 1.

In the processing of FIG. 5, the microcomputer 14 checks at step 201 whether the IC card has been inserted or extracted through the IC card I/F 16 at step 201. It reads in IC card information necessary for the toll charging processing through the IC card I/F 16 and stores the same in the memory 17*a* at step 202, if insertion of the IC card is detected. It clears the IC card information having been read in and stored in the memory 17*a*, when the IC card is extracted. Instead, it stores information indicative of no IC card in the memory 17*a* at step 203. The microcomputer 14 drives the display unit 15 to display the balance in the IC card as shown in FIG. 7D, when the IC card is inserted. It also drives the display unit 15 at step 204 to display 'NO CARD' as shown in FIG. 7E, when the IC card is extracted.

If the information indicating that the IC card has been extracted and is not present is stored in the memory 17*a*, it can be understood that no IC card has been inserted in the course of communication processing with the road-side communication device 3 at the entrance gate. In this instance, the toll charge may be issued in separate manners other than described above. For instance, the toll charge may be made by mailing a debit note to a vehicle user.

Second Embodiment

Figure 8:
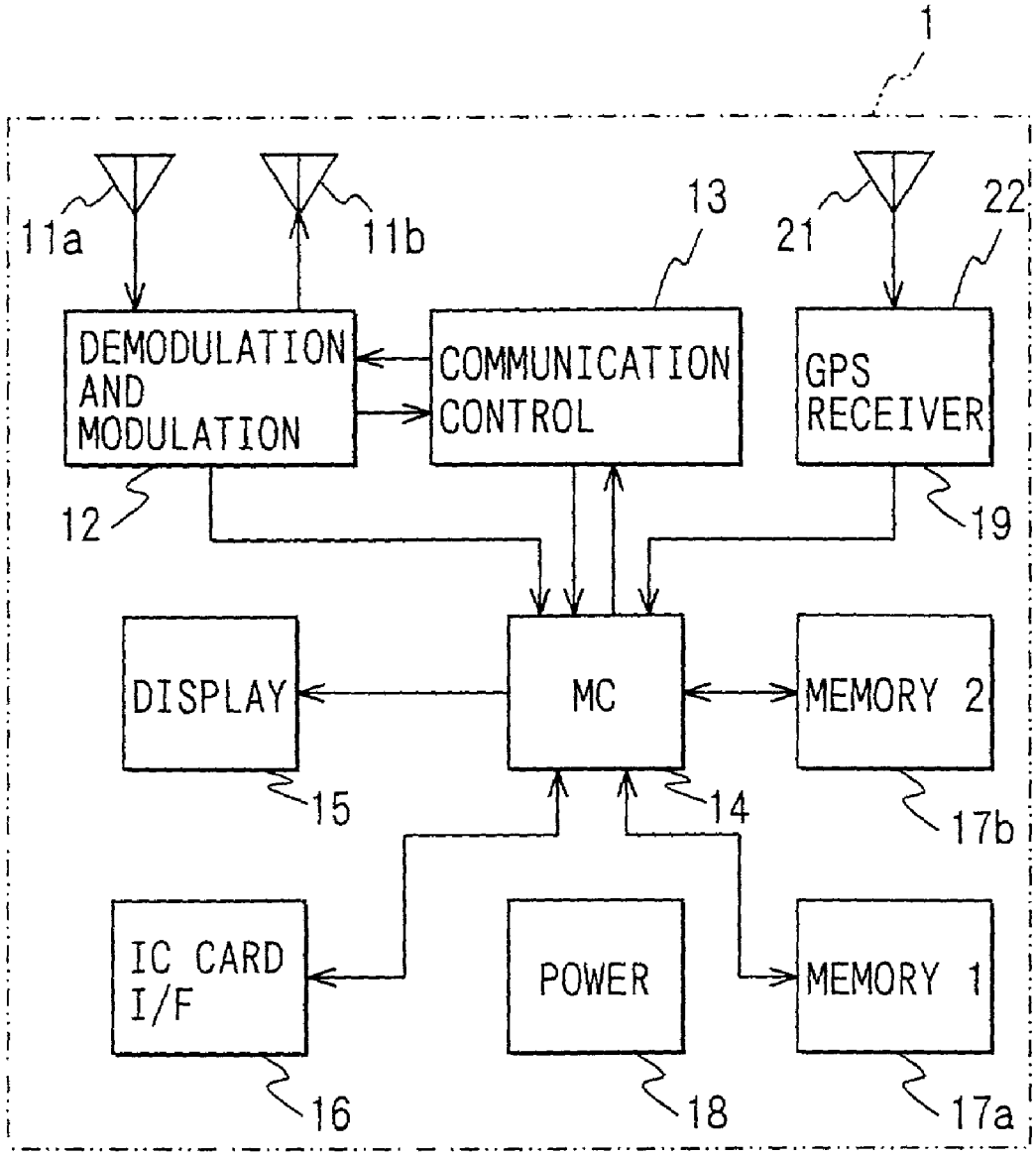
FIG. 8 is a block diagram showing a mobile radio communication device for an automatic toll collection system according to a second embodiment of the present invention.

In this embodiment, as shown in FIG. 8, the GPS antenna 21 and the GPS receiver circuit 22 are provided in the in-vehicle radio communication device 1 to retrieve the present position signal from the GPS receiver circuit 22. In this instance, the above travel guide can be provided even in vehicles having no navigation systems.

Third Embodiment

Figure 9:
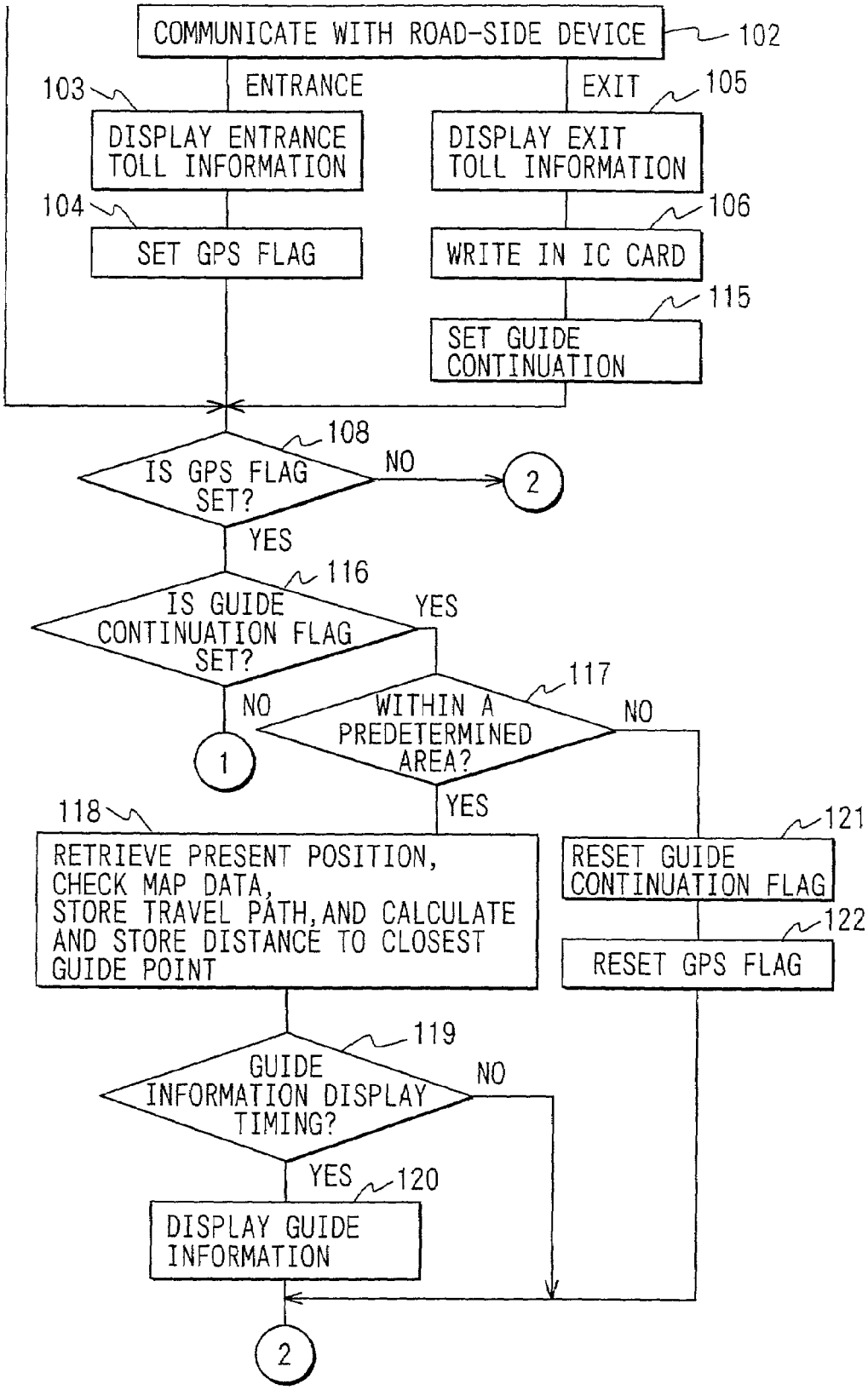
FIG. 9 is a flow diagram showing a part of main routine processing executed in a third embodiment of the present invention.

In this embodiment, map data of a predetermined area which exists following the exit gate G2 is received from the road-side communication device 3 at the exit gate G2, and a travel guide may be provided in areas of the received map data outside of the toll charge area. This processing is shown in FIG. 9 as a partial modification of that shown in FIG. 3 (first embodiment). The map data covering the predetermined area following the exit gate G2 is received from the road-side communication device 3 at the exit gate G2 and is stored in the memory 17*a* in the toll charge communication processing (step 102) at the exit gate G2.

Similar to the processing in FIG. 3, the exit toll charge information is displayed at step 105 and written into the IC card at step 106. Then, the microcomputer 14 sets a travel guide continuation flag at step 115. The GPS measurement flag is not reset at this moment in this case. As a result, the check result at step 108 turns to YES. The microcomputer 14 checks at step 116 whether the travel guide continuation flag has been set. The check result remains YES as long as the travel guide continuation flag remains set. The microcomputer 14 then checks at step 117 whether the present position is within the above predetermined area. This check may be made by checking the present position signal received from the GPS receiver circuit 22 with the map data received at the exit gate and stored in the memory 17*a*.

If the check result indicates that the vehicle is within the predetermined area, the microcomputer 14 executes at step 118 to calculate a distance to a closest guide point similarly as at step 109. The microcomputer 14 subsequently checks at step 119 whether the distance to the closest point decreased to a predetermined distance in the similar manner as at step 113. If the check result indicates that the vehicle has approached to be less than the predetermined distance, the microcomputer 14 drives the display unit 15 at step 120 to display guide information in correspondence with such a guide point similar to step 114. Thus, the travel guide can be provided in the predetermined area even after passing the exit gate G2.

If the vehicle leaves the predetermined area, the check result at step 117 changes to NO. The microcomputer 14 resets the travel guide continuation flag at step 121 and the GPS measurement flag at step 122. Thereafter, no travel guide is provided as in the above first embodiment.

The above embodiments may be modified in various ways. For instance, the special toll to be charged may be fixed by transmitting to the road-side communication device 3 information indicating that the vehicle has traveled in the special toll area, when it is determined that the mobile body has traveled in the special toll area. As long as map data is received at gates, similar travel guide can be provided even in the case in which no toll charge area is defined. It is possible to combine the above other embodiments as the case may be. Vocal sounds may be used as for providing travel guide in place of displaying information visually. The travel distance may be calculated based on signals from a distance sensor.

Other modifications and alterations are also possible without departing from the spirit of the invention.

What is claimed is:

1. A mobile radio communication device for an automatic toll collection system which charges a toll of a mobile body by executing communications with rode-side communication devices at an entrance gate and an exit gate, the device comprising:

antennas for receiving map data of the toll charge area from the road-side communication device at the entrance gate;

a GPS receiver I/F for receiving present position information of the mobile body;

a processor configured to facilitate storing as travel path data the present position of the vehicle on the map, calculating an accumulated travel distance covering from the entrance of the toll charge area to the present position based on the travel path data, and calculating an actual travel distance of the mobile body In a toll charge area between the entrance gate and the exit gate based on the accumulated travel distance, wherein the antenna are for transmitting the calculated distance of actual travel of the vehicle to the road-side communication device when at the toll charge area, and for receiving a toll charge calculated based on the calculated distance of actual travel from the road-side communication device; and output means for outputting the toll charge in the vehicle, wherein the processor check whether the mobile body has traveled in a special toll area based on the map data and the present position information when the toll charge area includes a special toll area in which a special toll is charged and charges the special toll when a check result indicates that the mobile body has traveled in the special toll area, and wherein the processor calculates the special toll in correspondence with a distance which the mobile body has traveled in the special toll area.

2. The mobile radio communication device as in claim 1, further comprising:

memory for to data of an actual travel path of the mobile body, wherein the processor calculates the actual travel distance from the stored data of the actual travel path.

3. The mobile radio communication device as in claim 1, wherein the antenna further receive map data corresponding to an outside area of the toll charge area from road-side communication device at the exit gate, and the processor provides a further travel guide based on the map data received at the exit gate and the present position information.

4. The mobile radio communication device as in claim 3, wherein the processor provides the travel guide by informing a driver of a guide point close to the present position of the mobile body based on the map data and the present position information.

5. The mobile radio communication device as in claim 1, wherein the processor provides a travel guide by informing a driver of a guide point close to the present position of the mobile body based on the map data and the present position information.

6. A mobile radio communication method for an automatic toll collection system comprising the steps of:

receiving map data of a toll charge area from road-side communication devices provided in the toll charge area upon entering and leaving the toll charge area;

receiving present position information of a vehicle from a GPS system;

executing predetermined processing based on the present position information and the map data, the predetermined processing including storing as travel path data the present position of the vehicle on the map, calculating an accumulated travel distance covering from the entrance of the toll charge area to the present position based on the travel path data, and calculating a distance of actual travel of the vehicle in the toll charge area based on the accumulated travel distance;

transmitting the calculated distance of actual travel of the vehicle to the road-side communication device when leaving the toll charge area;

calculating a toll charge in the toll charge area based on the calculated distance of actual travel;

receiving the calculated toll charge through the road-side, communication device; and outputting the calculated toll charge in the vehicle, wherein the executing further includes:

checking whether the vehicle is in a special toll charge area in the toll charge area the special toll charge area being for charging a special toll different from a normal toll in a normal toll charge area of the toll charge area; and calculating the special toll charge and the normal charge separately in correspondence with distance of actual travel of the vehicle in the special toll charge area and the normal charge area respectively.

7. The mobile radio communication method as in claim 6, wherein the executing includes checking whether the vehicle has arrived at a point which is within a predetermined distance from a predetermined guide point; and the outputting outputs the travel guide information of the predetermined guide point only when the vehicle has arrived at the point which is within the predetermined distance.

8. The mobile radio communication method as in claim 6, wherein the executing includes checking whether the vehicle has arrived at a point which is within a predetermined distance from a predetermined guide point; and the outputting outputs the travel guide information of the predetermined guide point only when the vehicle has arrived at the point which is within the predetermined distance.

9. The mobile radio communication method as in claim 6, wherein the executing includes:

providing both toll charge and the travel guide information while the vehicle is in the toll charge area; and providing only the travel guide information after the vehicle has left the toll charge area.

10. The mobile radio communication method as in claim 6, wherein the executing includes:

providing both the toll charge and the travel guide information while the vehicle is in the toll charge area; and providing only travel guide information after the vehicle has left the toll charge area.

11. The mobile radio communication method as in claim 7, wherein the executing includes:

providing both the toll charge and the travel guide information while the vehicle is in the toll charge areas; and providing only the travel guide information after the vehicle has left the toll charge area.

* * * * *